United States Patent [19]

McDonald

[11] Patent Number: 5,074,621

[45] Date of Patent: Dec. 24, 1991

[54] CHAIR BACK SEAT CONSTRUCTION

[75] Inventor: William McDonald, Hawthorne, Calif.

[73] Assignee: Systems Furniture Company, Torrance, Calif.

[21] Appl. No.: 443,525

[22] Filed: Nov. 30, 1989

[51] Int. Cl.[5] ..... A49C 7/00; A49C 15/00

[52] U.S. Cl. ..... 297/443; 297/460; 297/354

[58] Field of Search ..... 297/443, 460, 354, 362

[56] References Cited

U.S. PATENT DOCUMENTS

| | | | |
|---|---|---|---|
| 2,784,769 | 3/1957 | Fisher | 297/443 X |
| 4,099,774 | 7/1978 | Sandham | 297/443 X |
| 4,386,805 | 6/1983 | Boisset | 297/362 |
| 4,744,603 | 5/1988 | Knoblock | 297/460 X |

FOREIGN PATENT DOCUMENTS

| | | | |
|---|---|---|---|
| 2735522 | 2/1979 | Fed. Rep. of Germany | 297/354 |
| 70263 | 11/1958 | France | 297/443 |
| 89729 | 6/1957 | Norway | 297/443 |
| 913918 | 12/1962 | United Kingdom | 297/354 |

*Primary Examiner*—Peter A. Aschenbrenner
*Attorney, Agent, or Firm*—Pennie & Edmonds

[57] ABSTRACT

A chair which can be shipped in at least two pieces including the back and the remainder of the chair. The back has attached to it a curved prong which is insertable in a curved channel in the remainder of the chair. The prong and channel are shaped and proportioned so that they can be readily assembled. Latch means hold the seat and back together after prong insertion.

4 Claims, 2 Drawing Sheets

CHAIR BACK SEAT CONSTRUCTION

BACKGROUND OF THE INVENTION

Seating devices having parts readily assembled after shipment have been proposed (U.S. Pat. Nos. 488,095; 2,625,988; 2,842,186; 2,955,641; and 3,990,745).

Chairs with back uprights having rectangular openings to receive flattened ends of the chair frame have been disclosed (U S. Pat. No. 2,281,902) but none of the prior art arrangements have been satisfactory for ease and reliability of attachment, particularly for chairs that are often picked up and moved to new locations.

SUMMARY OF THE INVENTION

Broadly, the present invention comprises a chair assembly having a seat portion and back portion in which the upper chair back carries at least one curved prong which is placed in a curved walled channel located in the lower chair back. The prong and channel are shaped and curved so that the prong must be oriented to a position in which the upper chair back is acutely angled to the horizontal in order to accomplish insertion. During insertion the back is rotated to its vertical position. A latch secures the seat and back portions together. When the chair is lifted upwardly by its back the prong engages the walls of the channel and will not come out.

It is a feature of the assembly that the prong does not closely fit in the slots thus making production tolerances easier to meet thus reducing cost and assembly time.

DESCRIPTION OF THE PREFERRED EMBODIMENT

Figure 1:
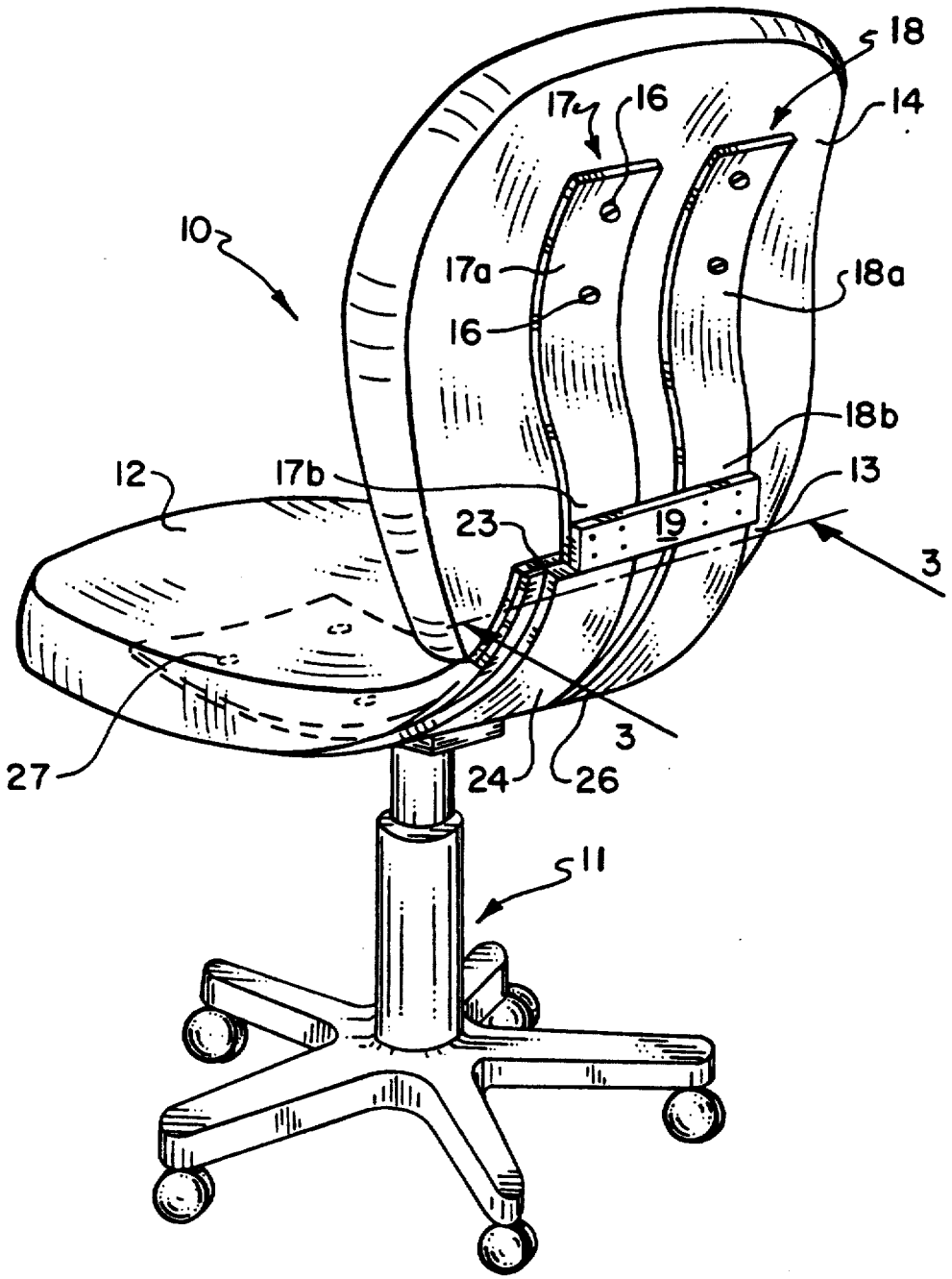
FIG. 1 is a perspective view of the assembled chair with plastic removed.

In FIGS. 1–4, chair 10 includes pedestal 11, seat 12, removable lower back portion 13 and upper back portion 14. Fastened with screws 16 to upper back portion

14, are curved prongs 17 and 18 stabilized by crosspiece 19.

Each dual curved prong 17 and 18 includes upper curved section 17*a*, 18*a* and lower reverse curved sections 17*b*, 18*b*. Lower reverse curved sections 17*b*, 18*b* are insertable into pocket channels 21 and 22 formed by curved plate 23 and curved pocket slats 24, 26 which are secured by fasteners 27 to seat 12. The chair seat 12, lower back 13 and upper back 14 are covered with plastic backing material 15 for appearance purposes.

Figure 2:
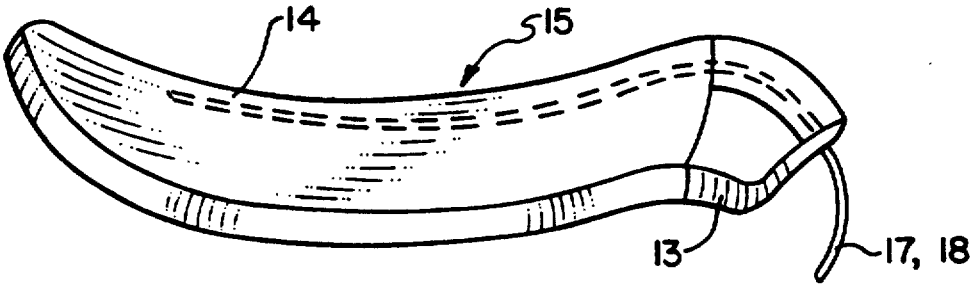
FIG. 2 is a side elevational view of the assembled chair and also showing the orientation of the upper back just assembly (dashed lines)
Figure 2:
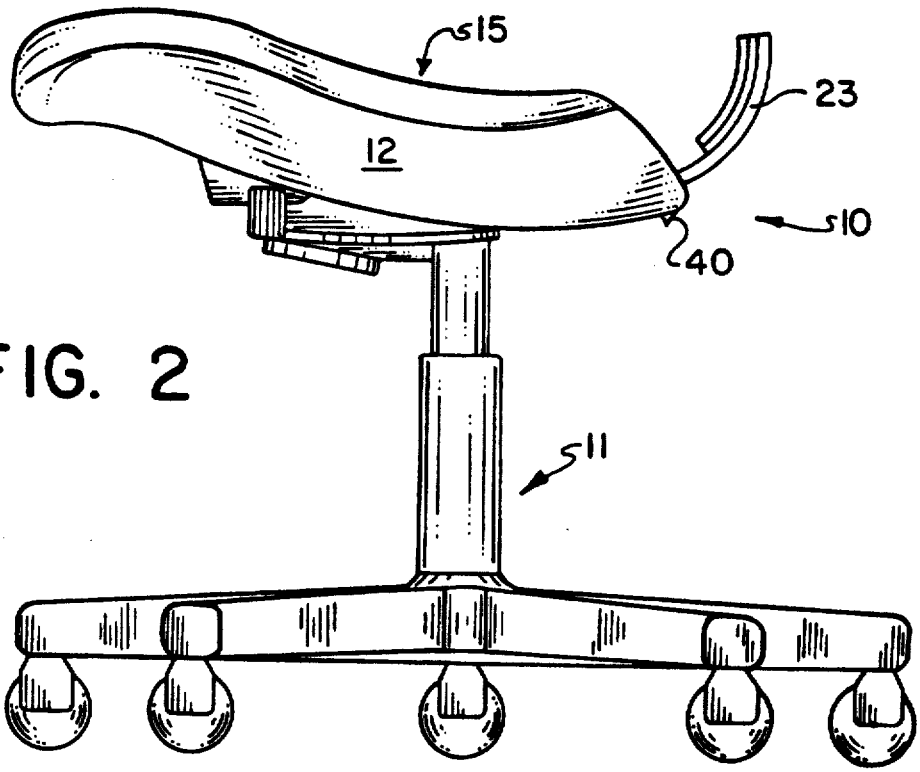
Figure 3:
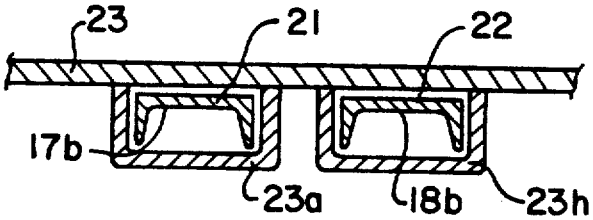
FIG. 3 is a sectional line along line 3—3 of FIG. 1.
Figure 4:
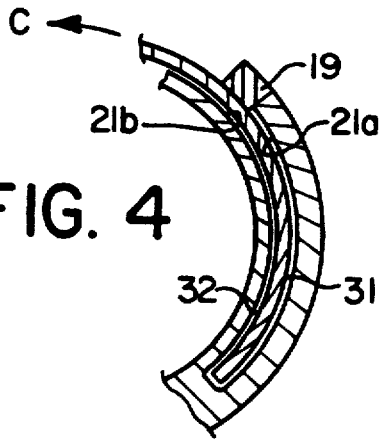
FIG. 4 is a partial side elevational view of a prong in a channel.
Figure 5:
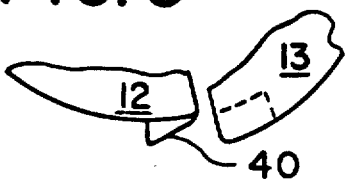
FIG. 5 an exploded partial view showing a releasable engagement clip.

Assembly of upper back portion 14 to the remainder of chair 10 includes the initial step in which the upper back portion 14 is placed in the position shown by dashed lines on FIG. 2 with lower reverse curved sections 17*b*, 18*b* of prongs 17 and 18 poised to enter channels 21 and 22 formed of plate 23 and U-shaped pieces 23*a*, 23*b*. The prongs 17, 18 are then moved and rotated into channels 21 and 22. Cross piece 19 limits the movement into the channels 21, 22 as piece 19 abuts plate 23. Seat 12 carries a latch piece 40 which latches into lower back recess 41 to secure the seat and lower back together. Latch piece 40 is depressible for releasing it from recess 41 when the chair 10 is disassembled. Thereafter when chair 10 is lifted vertically by its upper back 14, prongs 17 and 18 cannot be removed due to the latching arrangement.

I claim:

1. In a chair supportable on a surface having a curved seat with an upper seating surface and an under surface and a curved back portion which is readily assembled and disassembled from the seat comprising a. curved prong secured to a removable back portion;

b. a curved channel having a horizontal width greater than its vertical height mounted substantially between the upper seating seat surface and the seat under surface, said channel being sized and shaped so that the curved prong can be readily inserted therein to bring the seat and back portion adjacent one another;

c. stop means on the prong for limiting the movement of the back portion with respect to the seat portion; and d. latch means on the seat and back for holding the seat and back together after prong insertion.

2. The chair of claim 1 in which the curved prong has dual curves.

3. The chair of claim 1 in which the chair has a pair of prongs and a pair of channels.

4. The chair of claim 1 in which the prong is mounted in and projects from the back portion and the curved channel is mounted in and projects from the seat.

* * * * *